US006302708B1

(12) United States Patent
Okabe et al.

(10) Patent No.: US 6,302,708 B1
(45) Date of Patent: Oct. 16, 2001

(54) CONNECTOR FOR SUBSTRATE

(75) Inventors: Toshiaki Okabe; Chieko Torii, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/512,078

(22) Filed: Feb. 24, 2000

(30) Foreign Application Priority Data

Feb. 25, 1999 (JP) ..... P11-048848

(51) Int. Cl.[7] ..... H01R 9/09
(52) U.S. Cl. ..... 439/78
(58) Field of Search ..... 439/78, 81, 82, 439/83, 84, 55, 58, 68

(56) References Cited

U.S. PATENT DOCUMENTS 4,269,467 * 5/1981 Hughes ..... 339/126
4,479,686 * 10/1984 Hoshino et al. ..... 439/78
4,732,565 * 3/1988 Ito et al. ..... 439/79
4,739,139 * 4/1988 Ikeda ..... 200/294
4,767,342 * 8/1988 Sato ..... 439/78
5,183,404 * 2/1993 Aldous et al. ..... 439/55
6,045,372 * 4/2000 Lian et al. ..... 439/83

* cited by examiner

*Primary Examiner*—Brian Sircus
*Assistant Examiner*—Thanh-Tam Le
(74) *Attorney, Agent, or Firm*—Finnegan, Henderson, Farabow, Garrett & Dunner, L.L.P.

(57) ABSTRACT

A connector for a wiring substrate 2 is provided. The connector includes a connector housing 1 and tabs 3 in the connector housing 1. Each tab 3 consists of a lower extension part 3*a*, a horizontal part 3*b* and an upper extension part 3*c*. In arrangement, the connector housing 1 is fixed on the wiring substrate 2. The horizontal part 3*b* traverses in a direction of the thickness of the connector housing 1. The lower extension part 3*a* extends along an inner face of the connector housing 1. The upper extension part 3*c* penetrates the wiring substrate 2 and is soldered to a circuit pattern formed on the wiring substrate 2 at a soldering part 7.

5 Claims, 3 Drawing Sheets

CONNECTOR FOR SUBSTRATE

BACKGROUND OF THE INVENTION

1. Field of the Invention

The present invention relates to a connector assembled to a wiring substrate and particularly, it relates to an improvement of a tab structure of the connector.

2. Description of the Related Art

In the conventional connector, a female connector housing is fixed on the under face of the substrate so as to agree with a rectangular opening in the wiring substrate. The connector housing of this kind is equipped with a plurality of tabs. In spite of one piece of conductive metal plate, each tab can be divided into three sections by folding: a base part; an inner extension part extending from an inner end of the base part upward; an outer extension part extending from an outer end of the base part upward. In this way, the tab is shaped to have a substantial U-shape d configuration. In arrangement, the tab is arranged so that the base part creeps on the bottom of the housing and the inner extension part projects into the interior of the connector housing. The outer extension part is arranged so as to extend along the outer wall of the connector housing upward thereby to project from the top face of the wiring substrate. On the side of the top face, the outer extension part is soldered to a circuit pattern constructed on the substrate for electrical connection.

There is also known another connector structure where a female connector housing is apart from the wiring substrate. In this case, the connector housing is carried by the wiring substrate through the intermediary of tabs. Similarly to the previous connector, each tab of the connector has a substantial U-shaped configuration, consisting of the base part, the inner extension part and the outer extension part. Equally, the tab is arranged in a manner that the base part creeps on the bottom of the housing and the inner extension part projects into the housing, while the outer extension part projects on the back face of the wiring substrate. On the side of the back face, the outer extension part is soldered to a circuit pattern of the substrate.

Since the above-mentioned connectors of two kinds adopt the U-shaped tabs in common, it is necessary to lengthen the outer and inner extension parts corresponding to the height of the housing. That is, in common with the former and latter connectors, each tab has a long length in its unfolded condition and the outer extension parts of the tab exposes itself to the outside of the housing. Consequently, there arises a problem of causing the connector to be large-sized, reducing the reliability.

Additionally, in case of the above connector in which an inner extension part of each tab projects upward, the male connector to be mated with the connector is necessary to have a structure to accept the inner extension part, exhibiting a reduced application for the male connector for flexible wiring substrate.

SUMMARY OF THE INVENTION

Under the circumstances, it is therefore an object of the present invention to provide a connector for a substrate, which is capable of miniaturizing the connector itself and improving the reliability by the improvement of the structure of tabs. Further, it is another object of the invention to provide the connector which can ensure the application for a male connector for a flexible wiring substrate.

The object of the present invention described above can be accomplished by a connector for a wiring substrate having a circuit pattern formed thereon, the wiring substrate having an opening, the connector comprising:

a connector housing provided with a bottom and a fitting port, the connector housing being fixed on the wiring substrate so that the fitting port agrees with the opening of the wiring substrate; and at least one tab in the form of a conductive metal piece which is arranged inside and outside the connector housing;

wherein, in an arrangement where the connector housing is positioned under the wiring substrate, the tab consists of a lower extension part extending downward, a horizontal part succeeding to an upper end of the lower extension part at substantial right angles and extending horizontally and an upper extension part succeeding to an end of the horizontal part and extending upward; and the tab is arranged on the connector housing so that the horizontal part traverses in a direction of the thickness of a sidewall forming the connector housing and the lower extension part extends along an inner face of the sidewall, while the upper extension part penetrates the wiring substrate and is soldered to the circuit pattern of the wiring substrate.

With the arrangement of the tab, it is possible to reduce the length of the upper extension part in comparison with that of the conventional connector, thereby decreasing the length of the unfolded tab. Further, since the tab does not expose itself to the outside of the connector housing, it is possible to provide the small-sized connector. With the arrangement of the lower extension part on the inner face of the connector housing, the so-constructed connector can be used in combination with a normal male connector for a flexible wiring substrate.

According to the second aspect of the invention, the connector housing has a groove formed on an inner face of the sidewall of the connector housing for receiving the lower extension part and another groove formed on an upper end face of the sidewall for receiving the horizontal part.

In this case, the lower extension part and the horizontal part can be retained in the grooves certainly. Accordingly, in case of the connector housing equipped with a plurality of tabs, they can be positioned on the connector housing at precise intervals.

According to the third aspect of the invention, the fitting port of the connector housing is shaped to be rectangular.

In this case, the male connector to be mated to the connector housing is also shaped to be rectangular.

According to the present invention, there is also provided a connector for a wiring substrate having a circuit pattern formed thereon, the wiring substrate having an opening, the connector comprising:

a connector housing provided with a bottom and a fitting port, the connector housing being adjusted in position so that the fitting port agrees with the opening of the wiring substrate; and at least one tab in the form of a conductive metal piece which is arranged inside and outside the connector housing;

wherein, in an arrangement where the connector housing is positioned under the wiring substrate in a distance, the tab consists of a lower extension part extending downward, a horizontal part succeeding to the upper end of the lower extension part at substantial right angles and extending horizontally and an upper extension part succeeding to an end of the horizontal part and extending upward; and the tab is arranged on the connector housing so that the lower extension part extends in the connector housing toward the bottom of the housing, the horizontal part penetrates a sidewall forming the connector housing, and the upper extension part extends outside the connector housing upward and penetrates the wiring substrate and is soldered to the circuit pattern on the wiring substrate.

With the arrangement of the tab, it is possible to reduce the length of the upper extension part subjected to exposure to the outside of the connector housing. Therefore, the length of the unfolded tab can be decreased thereby to provide the small-sized connector.

According to the fifth aspect of the invention, the horizontal part is provided, on the side of the fitting port of the connector housing, with a tapered face.

Owing to the provision of the tapered face, it is possible to reinforce the tab's portion to be abutted against a spring part of the male connector. Furthermore, the tapered face of the horizontal part allows the spring part of the male connector to pass through the horizontal part with ease.

According to the sixth aspect of the invention, the fitting port of the connector housing is shaped to be rectangular in the latter invention.

Also in this case, the male connector to be mated to the connector housing is also shaped to be rectangular.

These and other objects and features of the present invention will become more fully apparent from the following description and appended claims taken in conjunction with the accompany drawings.

DESCRIPTION OF THE PREFERRED EMBODIMENT

Embodiments of the present invention will be described with reference to the drawings.

Figure 1:
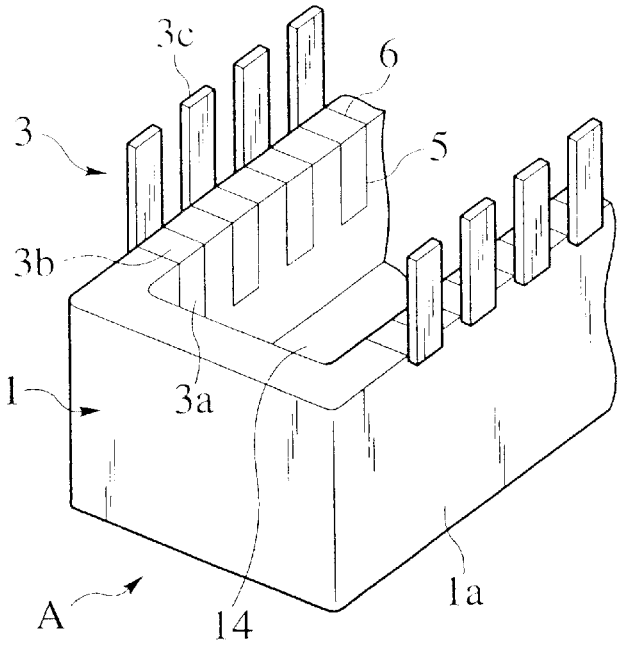
FIG. 1 is a perspective view of a connector for substrate, in accordance with the first embodiment of the present invention.
Figure 2:
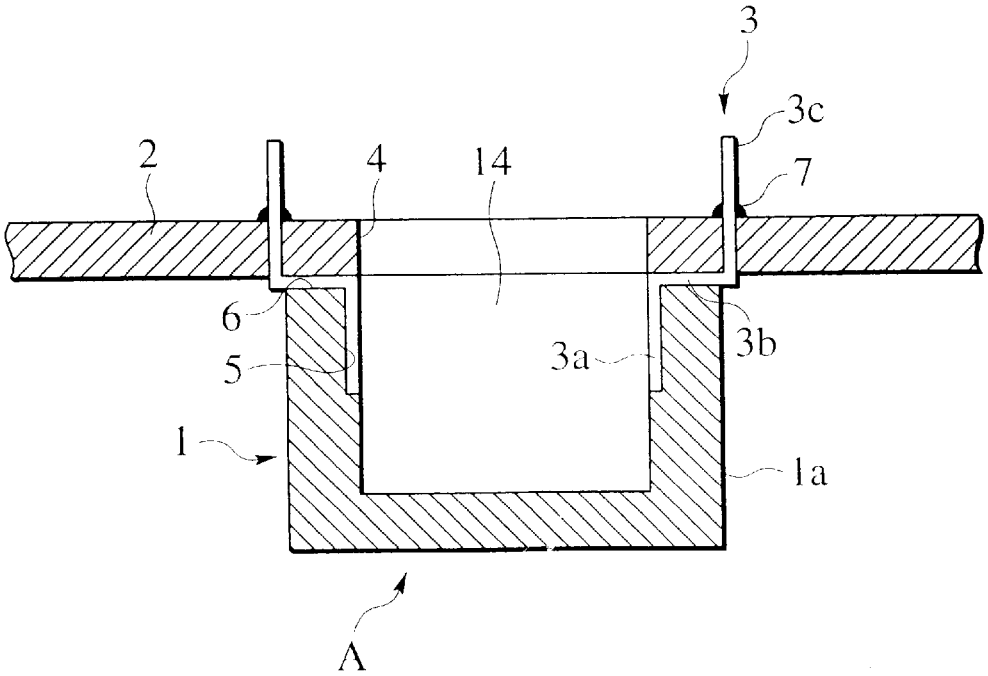
FIG. 2 is a side view showing a longitudinal section of the connector in accordance with the first embodiment of the present invention.

FIGS. 1 and 2 show the first embodiment of the present invention. A connector housing 1 constituting a female connector A is fixed on the under face of a wiring substrate 2 so that a fitting port 15 of the connector housing 1 coincides with a rectangular opening 4 of the wiring substrate 2. The connector A is provided, on the connector housing 1, with a plurality of tabs 3 in the form of conductive metal pieces. By folding, each tab 3 consists of a lower extension part 3*a*, a horizontal part 3*b* connected to the upper end of the lower extension part 3*a* at right angles and an upper extension part 3*c* connected to the outer end of the horizontal part 3*b*. The respective lower extension parts 3*a* of the tabs 3 are fitted in grooves 5 formed in the inner face of a sidewall 1*a* of the connector housing 1, while the horizontal parts 3*b* are fitted into grooves 6 formed on the upper edge of the sidewall 1*a*. The upper extension parts 3*c* of the tabs 3 are arranged to project above the wiring substrate 2 and connected to a circuit pattern (not shown) built on the back face of the wiring substrate 2 through soldering parts 7.

Then, the tabs 3 may be provided in the form of ones integrated with the connector housing 1 by insert-molding. Alternatively, the tabs 3 are fitted into the grooves 5, 6 after forming the connector housing 1.

As mentioned above, since the connector A of the embodiment has the lower extension parts 3*a* extending along the inner face of the connector housing 1, it is possible to use a male connector for a flexible wiring board.

Figure 5:
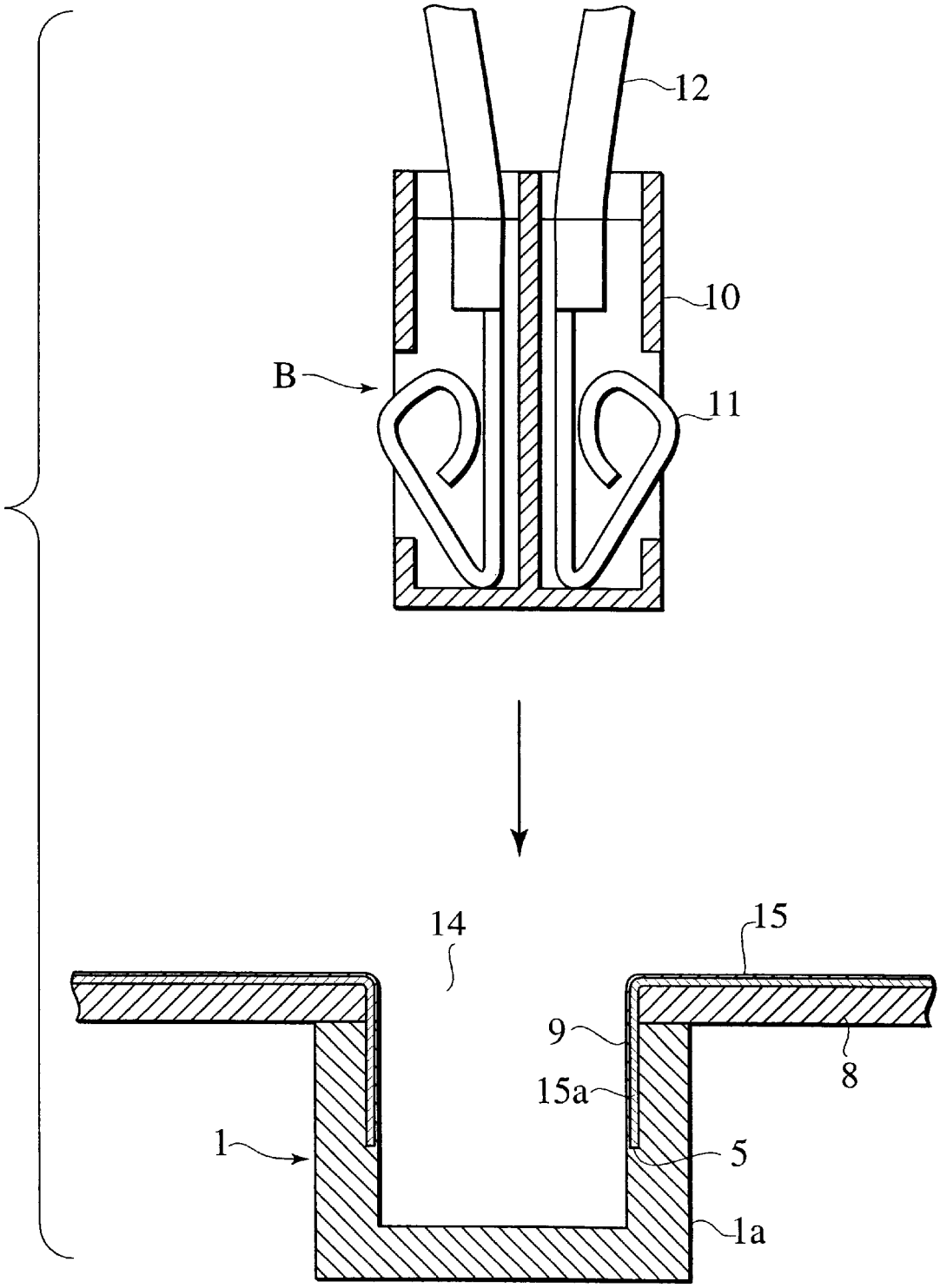
FIG. 5 is a side view showing respective longitudinal sections of the general male connector for a flexible wiring substrate and the connector for substrate for the flexible wiring substrate.

FIG. 5 shows the male connector B, i.e. a general male connector for flexible wiring board. In FIG. 5, the shown male connector B connected to a wire harness 12 is a normal connector which includes spring terminals 11 attached on both sides of a main body 10. As shown in FIG. 5. the substrate connector has a flexible wiring board 15 attached to the upper face of a substrate 8. The flexible wiring board 15 has an end 15*a* bent downward and fitted on the inner face of the connector housing 1. With the arrangement, when inserting the male connector B into a fitting port 14, then the spring terminals 11 come into contact with a circuit pattern 9 formed on the flexible wiring board 10, so that the pattern 9 is connected with the wire harness 12.

According to the first embodiment, since the tabs 3 each consisting of the lower extension part 3*a*, the horizontal part 3*b* and the upper extension part 3*c* are arranged along the inner face and the upper end of the connector housing 1, it is possible to reduce the unfolded lengths of the tabs 3 in comparison with those of the tabs in the conventional connector. Further, since the tabs do not expose themselves to the outside of the connector housing 1, the dimensions of the connector can be small-sized thereby to improve the reliability because of no interference with the other members.

Furthermore, by inserting the above-mentioned male connector B into the connector housing 1 through the fitting port 14, the spring terminals 11 of the male connector B can be brought into contact with the lower extension parts 3*a* of the tabs 3, accomplishing the electrical connection. Therefore, it is possible to use the connector of the invention together with the general male connector B for flexible wiring board, exhibiting an advantage of improving the general use.

Figure 3:
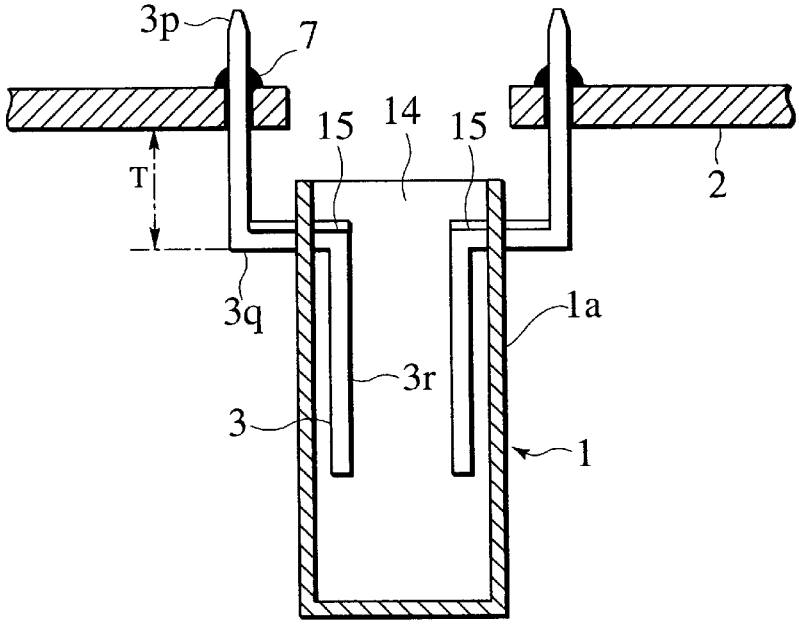
FIG. 3 is a side view showing a longitudinal section of the connector in accordance with the second embodiment of the present invention.

FIG. 3 shows a connector for substrate, in accordance with the second embodiment of the present invention. According to the embodiment, the fitting port 14 is arranged in opposition to the first embodiment and separated from the wiring substrate 2. Thus, the connector housing 1 of bottom type is apart from the wiring substrate 1 and carried by the wiring substrate 2 through the tabs 3. Each tab 3 consists of an upper extension part 3*p*, a horizontal part 3*q* connected to the lower end of the upper extension part 3*p* at right angles and a lower extension part 3*r* connected to the inner end of the horizontal part 3*q*. The structure of the tab 3 is similar to that of the first embodiment. In the connector housing 1, the lower extension parts 3r of the tabs 3 extend in the connector housing 1 downward, that is, toward the bottom of the connector housing 1. The horizontal parts 3*q* are drawn out of the connector housing 1 through the sidewalls 1*a*. The upper extension parts 3*p* project upward and penetrate the wiring substrate 2 and are soldered to the circuit pattern formed on the wiring substrate 2 at the soldering parts 7. The respective horizontal parts 3*q* of the tabs 3 are integrated with the connector housing 1 by the insert molding.

Figure 4:
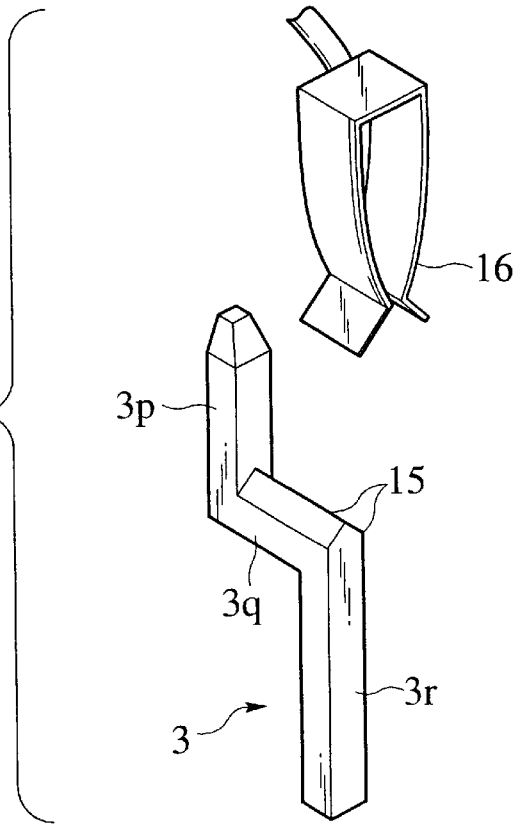
FIG. 4 is a perspective view of a tab constituting the connector of the second embodiment of the present invention.

In process of inserting the male connector having a spring part 16 of FIG. 4 into the connector housing 1 through the fitting port 14, the spring part 16 abuts on the horizontal part 3*q*. Therefore, according to the embodiment, the horizontal part 3*q* of each tab 3 is provided, on the side of the fitting port 14 of the connector housing 1, with a tapered face 15 which facilitates the insertion of the spring part 16.

According to the second embodiment, since the upper extension part 3*p* has a reduced dimension T, it is possible to shorten the unfolded length of the tab 3 in comparison with that of the conventional U-shaped tab thereby miniaturizing the connector itself. Further, with the reduced dimension T of the upper extension part 3*p*, it is possible to avoid the interference with the other members, improving the reliability.

Finally, it will be understood by those skilled in the art that the foregoing description is two preferred embodiments of the disclosed connector for substrate. Various changes and modifications may be made to the present invention without departing from the spirit and scope of the invention.

What is claimed is:

1. A connector for a wiring substrate having a circuit pattern formed thereon, the wiring substrate having an opening, the connector comprising:

a connector housing provided with a bottom and a fitting port, the connector housing being fixed on the wiring substrate so that the fitting port agrees with the opening of the wiring substrate; and at least one tab in the form of a conductive metal piece which is arranged inside and outside the connector housing;

wherein, in an arrangement where the connector housing is positioned under the wiring substrate, the tab consists of a lower extension part extending downward, a horizontal part extending to an upper end of the lower extension part at substantial right angles and extending horizontally and an upper extension part extending to an end of the horizontal part and extending upward;

wherein the tab is arranged on the connector housing so that the horizontal part traverses in a direction of a thickness of a sidewall forming the connector housing and the lower extension part extends along an inner face of the sidewall, while the upper extension part penetrates the wiring substrate and is soldered to the circuit pattern of the wiring substrate; and wherein the connector housing has a groove formed on an inner face of the sidewall of the connector housing for receiving the lower extension part and another groove formed on an upper end face of the sidewall for receiving the horizontal part.

2. A connector for a wiring substrate having a circuit pattern formed thereon, the wiring substrate having an opening, the connector comprising:

a connector housing provided with a bottom and a fitting port, the connector housing being fixed on the wiring substrate so that the fitting port agrees with the opening of the wiring substrate; and at least one tab in the form of a conductive metal piece which is arranged inside and outside the connector housing;

wherein, in an arrangement where the connector housing is positioned under the wiring substrate, the tab consists of a lower extension part extending downward, a horizontal part extending to an upper end of the lower extension part at substantial right angles and extending horizontally and an upper extension part extending to an end of the horizontal part and extending upward;

wherein the tab is arranged on the connector housing so that the horizontal part traverses in a direction of a thickness of a sidewall forming the connector housing and the lower extension part extends along an inner face of the sidewall, while the upper extension part penetrates the wiring substrate and is soldered to the circuit pattern of the wiring substrate;

wherein the connector housing has a groove formed on an inner face of the sidewall of the connector housing for receiving the lower extension part and another groove formed on an upper end face of the sidewall for receiving the horizontal part; and wherein the fitting port of the connector housing is shaped to be rectangular.

3. A connector for a wiring substrate having a circuit pattern formed thereon, the wiring substrate having an opening, the connector comprising:

a connector housing provided with a bottom and a fitting port, the connector housing being adjusted in position so that the fitting port agrees with the opening of the wiring substrate; and at least one tab in the form of a conductive metal piece which is arranged inside and outside the connector housing;

wherein, in an arrangement where the top surface of the connector housing is positioned under the wiring substrate in a distance, the tab consists of a lower extension part extending downward, a horizontal part extending to an upper end of the lower extension part at substantial right angles and extending horizontally and an upper extension part extending to an end of the horizontal part and extending upward; and the tab is arranged on the connector housing so that the lower extension part extends in the connector housing toward the bottom of the connector housing, the horizontal parts penetrate a sidewall forming the connector housing, and the upper extension part extends outside the connector housing upward and penetrates the wiring substrate and is soldered to the circuit pattern on the wiring substrate.

4. A connector for a wiring substrate as claimed in claim 3, wherein the horizontal part is provided, on the side of the fitting port of the connector housing, with a tapered face.

5. A connector for a wiring substrate as claimed in claim 4, wherein the fitting port of the connector housing is shaped to be rectangular.

* * * * *